US005860260A

United States Patent [19]

Hase

[11] Patent Number: 5,860,260

[45] Date of Patent: Jan. 19, 1999

[54] BLOCK MEMBER AND PANEL STRUCTURE

[75] Inventor: Toshizo Hase, Otsu, Japan

[73] Assignee: Nihon Koshitsu Garasu Kabushiki Kaisha, Kusatsu, Japan

[21] Appl. No.: 822,003

[22] Filed: Mar. 24, 1997

[30] Foreign Application Priority Data

Sep. 18, 1996 [JP] Japan ..... 8-246171

[51] Int. Cl.[6] ..... E04B 5/46

[52] U.S. Cl. ..... 52/307; 52/591.1; 52/396.09; 52/777

[58] Field of Search ..... 52/396.1, 396.08, 52/396.09, 307, 308, 476, 777, 778, 762, 591.1, 591.3, 586.1

[56] References Cited

U.S. PATENT DOCUMENTS

| | | | |
|---|---|---|---|
| 2,182,373 | 12/1939 | Cox | 52/396.08 X |
| 2,198,450 | 4/1940 | Chertkof | 52/396.08 X |
| 3,205,633 | 9/1965 | Nusbaum | 52/591.1 |
| 4,648,226 | 3/1987 | Manon | 52/308 |
| 4,744,194 | 5/1988 | Yasuyoshi | 52/778 X |
| 4,782,640 | 11/1988 | Scheiwiller | 52/591.1 |
| 4,807,412 | 2/1989 | Frederiksen | 52/591.1 X |
| 5,003,744 | 4/1991 | Taylor | 52/308 |
| 5,170,604 | 12/1992 | Hedly | 52/778 X |
| 5,259,161 | 11/1993 | Carter | 52/308 X |
| 5,448,864 | 9/1995 | Rosamond | 52/308 X |

*Primary Examiner*—Lanna Mai

*Attorney, Agent, or Firm*—Nikaido, Marmelstein, Murray & Oram LLP

[57] ABSTRACT

The invention provides a block member and a panel structure which are of a relatively simple construction, which may permit reduction in production and fabrication costs, which may be easily assembled with a sufficient strength, and which may have superior appearance when assembled. A block member comprises a block body 21 of a rectangular configuration having a center point and four sides, the block body including a flange portion 24 in the outer peripheral surface 21*c* of each of the four sides, the flange portions being formed integrally with the block body and protruding outwardly from the outer peripheral surface, the flange portions having a thickness less than that of the outer peripheral surface, each of the flange portions having a deformed portion 25 which restricts the amount of protrusion of the flange portion 24, the deformed portions being formed in the flange portions disposed at corner portions of the block body at which the adjoining sides of the block body meet together. The block members are clamped by the pair of support members disposed along the front and rear surface of the flange portions 24, through the use of a space defined by the deformed portions 25 and attachment holes in the support members.

5 Claims, 9 Drawing Sheets

BLOCK MEMBER AND PANEL STRUCTURE

FIELD OF THE INVENTION

This invention relates generally to a block member and a panel structure. More particularly, the invention relates to block members, such as glass bricks, glass blocks or the like, and a panel structure comprising at least such block members and support members suitable for use as a partition or a screen in an architectural construction.

BACKGROUND OF THE INVENTION

Conventionally, a panel structure of the above-mentioned type has been constructed by stacking glass blocks for example within an aluminum frame, with the aid of adhesive such as joint cement interposed between the glass blocks. Another panel structure has been constructed by stacking glass blocks directly on a portion of an architectural construction, with the aid of adhesive such as joint cement interposed between the glass blocks.

It is noted, however, that, according to such conventional construction methods, adhesive must be used in order to secure or fix glass blocks together. This requires a prolonged period of time both for curing and fabrication. In addition, an architectural construction to which such panel structure is applied and its periphery may frequently and undesirably be contaminated, when joint cement is used as an adhesive. It should be specifically noted that, when the above frame is used, alteration or change in size of a panel structure, in relation to a given architectural construction, could not be easily performed.

In order to solve the above problems, various proposals have been made heretofore. For example, a partition using glass panels is disclosed in Japanese Utility Model Publication No. 50-3384, and a glass block panel is disclosed in Japanese Utility Model Publication No. 52-30739.

In the construction of a panel unit in the former publication, the panel unit includes a pair of grids of a resin material. The pair of grids define an internal recess. A glass plate is fitted into the recess so as to be clamped by the pair of grids. The opposite ends of the panel unit are engaged in their corresponding engagement grooves respectively formed in upstanding two support columns disposed on opposite sides of the panel unit.

According to this proposal, the glass plate is supported by the pair of grids since it clamped between the pair of grids. Thus, adhesive such as joint cement may be completely obviated. This contributes to reduction in fabrication period. It is also possible to prevent an architectural construction and its periphery from contamination.

It is noted, however, that the size of the above-mentioned panel unit is fixed. Thus, although alteration in size of the panel unit itself is possible, more fine adjustment in size is not possible. This is problematic since use or application field of the panel unit is restricted. It is also noted that, since the glass plate is simply clamped by the pair of grids, support strength for the plate glass at the central portion of the panel unit is undesirably decreased. This causes dislodgment of plate glass from the panel unit due to strong vibrations or mechanical shock.

The pair of grids could be formed from a casting, in place of resin material. This might be effective in solving the above problem, but such grids would become extremely heavy, so that new problems such as restriction during fabrication may occur.

In the construction of a glass block panel for daylighting purpose in the latter publication, vertical and horizontal bars having a groove are disposed within an aluminum frame. Glass blocks having flange portions in their outer peripheral surface are disposed in spaces between the frame and the horizontal and vertical bars, and between the horizontal bars and the vertical bars. A rubber packing is disposed between each groove and each flange portion. The frame, the horizontal bars and the vertical bars are fixed together at their connections by means of screws.

According to this proposal, adhesive such as joint cement may be completely obviated, as in that of the former publication. Reduction in fabrication period may be obtained, and contamination of an architectural construction and its periphery may be prevented. It is also possible to prevent breakage of the glass blocks due to vibrations and mechanical shock.

It is noted, however, that, during fabrication stage, a rubber packing should be placed between the grooves of the frame, the vertical bars and the horizontal bars and the flange portions of the glass blocks. This causes assembling operation cumbersome, so that fabrication efficiency may be undesirably decreased. It is specifically noted that, since the portions of the frame, the horizontal bars and the vertical bars disposed oppositely to the glass blocks are formed into a grooved configuration which corresponds to the profile of the glass blocks (the shape of the flange portions), another glass blocks of the same outer dimension but having different profiles cannot be used. This is problematic in terms of interchangeability.

In order to solve the above-mentioned problems, the applicant previously proposed a panel structure shown in FIGS. 9 to 15. In these Figures, reference numeral 1 designates a first or vertical support member formed from a metal material, such as aluminum or steel member, into an elongated form. The vertical support member 1 includes a top plate 2, for example, of a planer configuration, a pair of side plates 3, 3 extending from the opposite side edges of the top plate in the same direction, and a pair of flange portions 4, 4 extending from the side edge of the respective side plate in a direction perpendicular thereto. The side plates 3, 3, together with the top plate 2, form a substantially U-shaped configuration. It is noted that the top plate 2 is formed with a plurality of holes 2*a* spaced apart from one another at a predetermined distance. Each of the side plates 3, 3 adjacent to the top plate 2 is formed with a plurality of slits 3*a* for receiving therein a second or horizontal support member which will be explained later. The slits 3*a* are spaced apart from one another at a distance the same as that of the holes 2*a*. Each of the flange portions 4, 4 is formed with a plurality of holes 4*a* for attachment thereof to a third support member which will be explained later. Although the slit 3*a*, which is disposed at one end of the side plate, is formed so as to have an open end, it may be formed into a configuration substantially the same as that of the slits 3*a* disposed in the central portion of the side plate.

The vertical support members 1 are so disposed that the top plates 2 of each pair of the support members 1 are oppositely disposed, and so that the pairs of the support members 1 are spaced apart from one another at a predetermined distance. A horizontal support member 5 is inserted in each slit 3*a* of the vertical support member 1, so as to form a grid-like configuration. The horizontal support member 5 is formed, for example, from a metal material, such as aluminum or steel, into an elongated web-like configuration. Holes 6 are also provided which correspond to the holes 2*a* of the vertical support member 1 spaced at a predetermined distance. The vertical support member 1 is formed first by forming the holes 2*a*, 4*a*, and slits 3*a*, for example, in a sheet metal by stamping operation, and then, bending the sheet metal in a predetermined direction, for example, by rolling or press operation, so as to obtain the configuration shown in FIG. 14.

Reference numeral 7 designates block members. The block member may include a glass block, a glass brick, a glass panel and so on. The material for the block member may include, other than glass, resin material, for example. The block member 7 is supported by the vertical support members 1 and the horizontal support members 5 which are arranged in a grid-like configuration, as mentioned above. More specifically, the front and rear surfaces of the block member 7 are supported, at the opposite ends thereof, by the flange portions 4, 4 of the vertical support members 1, and the opposite side surfaces of the block member 7 are supported by the side plates 3, 3 of the vertical support members 1. The top surface and bottom surface of the block member 7 are supported by the upper edges 5*a* and lower edges 5*b* of the horizontal support members 5.

The vertical support members 1 and the horizontal support members 5, having been assembled into a grid-like configuration as mentioned above, are tightly clamped by means of an attachment means 8, 9. More specifically, the attachment means 8 such as a bolt is inserted sequentially into the hole 6 of the horizontal support member 5, the hole 2*a* of the vertical support member 1, the hole 2*a* of the opposed vertical support member 1, and the hole 6 of the horizontal support member 5. Then, the attachment means 9, such as a nut, is threadingly engaged with the attachment means 8 (bolt). Thus, the pair of support members 1, 1 are brought into closer with each other, whereby the front and rear surfaces of the block member 7 are tightly clamped at their end portions by the flange portions 4, 4. Thus, the vertical and horizontal support members 1, 5 are unified.

Next, the way how the above-mentioned panel structure is assembled will be explained below. A plurality of vertical support members 1, being oriented in their substantially upright position, are arranged in forward and rearward rows and disposed spaced apart from one anther in each row at a distance substantially corresponding to the width of a block member 7. Horizontal support members 5, 5 are inserted in the respective lowermost slits 3*a* of the vertical support members 1. Then, a bolt 8 is inserted through a hole 6 of the horizontal support member 5 in the forward row, the hole 2*a* of the vertical support member 1, the hole 2*a* of the vertical support member 1 in the rearward row, and the hole 6 of the horizontal support member 5. The bolt is then threadingly engaged with a nut 9 for temporary securement thereof. The block member 7 in this state is inserted between the vertical support members 1, 1 from the above until the lower surface of the block member 7 is rested on the upper edge 5*a* of the horizontal support members 5, 5. An additional block member 7 is disposed adjacent to the first block member 7 in the above manner. A further additional block member 7 is disposed adjacent to the above additional block member 7, whereby the block member in a first stage (a first horizontal row) are all disposed in a proper manner. Then, a horizontal support member 5 is inserted into a slit 3*a* next to the lowermost slit 3*a* in the vertical support member 1. A bolt 8 is inserted in each hole 2*a* in the vertical support member 1. Each bolt 8 is temporarily and lightly tightened by means of a nut 9. An appropriate arrangement and adjustment operation is performed so that the opposite end portions of the front and rear surfaces of the block member 7 are engaged with the flange portions 4, 4 of the vertical support member 1, while the opposite side surfaces of the block member 7 are engaged with the side plates 3, 3 of the vertical support member 1. Then, the vertical support members 1 and the horizontal support members 5 in the forward and rearward row are tightened together by means of pairs of bolt 8 and nut 9 in the lowermost stage.

Subsequently, block members 7 in a second horizontal row are inserted between the pair of vertical support members 1, 1 from the above, so that their lower surfaces are mounted on the upper edges 5*a* of the pair of horizontal support members 5, 5. The above-mentioned operation is repeated in a similar manner. By this, a new block member 7 is disposed adjacent to the first block member 7 in the second horizontal row. Similarly, a further additional block member 7 is disposed adjacent to the new block member 7. In this manner, all block members 7 in the horizontal second row are properly arranged. Then, a horizontal support member 5 is inserted into the third slit 3*a* from the lowermost one. A bolt 8 is inserted into a respective holes 2*a* and 6 of the vertical support members 1. Each bolt 8 is temporarily and lightly tightened by means of a corresponding nut 9. As in the case of the first horizontal row of block member, an appropriate arrangement and adjustment operation is performed so that the opposite end portions of the front and rear surfaces of the block member 7 are engaged with the flange portions 4, 4 of the vertical support member 1, while the opposite side surfaces of the block member 7 are engaged with the side plates 3, 3 of the vertical support member 1. Then, the vertical support members 1 and the horizontal support members 5 in the forward and rearward row are tightened together by means of pairs of bolt 8 and nut 9 next to the lowermost stage. Similar operation will be repeated, so as to obtain a panel shown in FIG. 10.

According to the above-mentioned proposal, the vertical support members 1 having slits 3*a* in their side plates 3, 3, and the horizontal support members 5 are formed into a grid-like configuration, by inserting the horizontal support members 5 into the slits 3*a* in the vertical support members 1. The block members 7 of a rectangular configuration are disposed in their respective grid-like portions. The opposite end portions of the front and rear surfaces and the opposite end surfaces of the block members 7 are supported by the flange portions 4, 4 of the pair of vertical support members 1 and the side plates 3, 3. The lower and upper surfaces of the block members 7 are supported by the horizontal support members 5. Thus, the panel may be easily assembled, regardless of a given profile of the block member 7. It is also noted that adhesion such as joint cement is unnecessary, and contamination of an architectural construction and its periphery may be prevented.

The vertical support members 1 and horizontal support members 5 are integrally tightened, at their overlapped portions, by means of the attachment means 8, 9. Thus, supporting ability for the block members 7 and mechanical strength of the panel are improved and increased, respectively. Accordingly, dislodgment of the block members 7 from the vertical support members 1 or the horizontal support members 5 due to vibrations or mechanical shock may be prevented.

The block members 7 are supported by the vertical support members 1 and the horizontal support members 5 which are arranged in a grid-like configuration. Thus, panel size may be desirably changed by the size of the block member, when an appropriate length is selected for the vertical support members 1 and/or the horizontal support members 5. Accordingly, applicable field may be expanded, flexibility during fabrication may be enhanced, and reduction in fabrication period may be achieved.

Recently, it has been noticed that the panel structure advantageously provides design effects. Thus, the panel structures have various applications, other than partitions or screens for an architectural construction. Demand for the panel structure is increased, and, thus, easy applicability and cost reduction are highly required.

According to the above-mentioned proposal, the block members 7 are supported by the vertical support members 1 and the horizontal support members 5 of a web-like configuration which are combined into a grid-like configuration. It is noted, however, that the block members 7 are actually clamped and supported, at their front and rear surface on right-hand side and left-hand side, by the flange portions 4 of the vertical support members 1. Thus, the flange portions 4 are exposed only at the right-hand side and the left-hand side on the front and rear surface of the block members 7. This is disadvantageous in terms of providing good appearance.

The vertical support member 1 includes slits 3*a* and formed into a substantially C-shaped configuration. Thus, its shape or configuration is different from that of the horizontal support member 5 which is of a web-like configuration. This inevitably increases the type of the support members and requires cumbersome production process. Reduction in manufacturing cost is also difficult. It is specifically noted that, as the panel structure increases in size, more complicated process for fabricating the vertical support members is required, thus increasing manufacturing cost.

It is also noted that the block members 7 are supported in a following manner. First, the vertical support members 1 and the horizontal support members 5 of a web-like configuration are combined into a grid-like configuration by inserting each horizontal support member 5 into a slit 3*a* of a corresponding vertical support member 1. Then, block members 7 are mounted on the horizontal support members 5. Consequently, each block member 7 is clamped, at its left-hand and right-hand sides on front and rear surfaces, by the flange portions 4 of the vertical support members 1. Thus, such panel structure may be efficiently fabricated or constructed at site as compared to conventional one. It is noted, however, that further improvement is required for such panel structure, since more efficient and readily applicable panel structure is desired.

SUMMARY OF THE INVENTION

It is therefore a main object of the invention to provide a block member and a panel structure which are of a relatively simple construction, which may permit reduction in production and fabrication costs, which may be easily assembled with a sufficient strength, and which may have superior appearance when assembled.

In order to solve the above-mentioned problems experiences with prior art, a first invention provides a block member comprising a block body of a rectangular configuration having a center point and four sides, the block body including a flange portion in the outer peripheral surface of each of the four sides, the flange portions being formed integrally with the block body and protruding outwardly from the outer peripheral surface, each of the flange portions having a deformed portion which restricts the amount of protrusion of the flange portion, the deformed portions being formed in the flange portions in a symmetric relationship with respect to the center point of the block body.

A second invention provides a block member comprising a block body of a rectangular configuration having a center point and four sides, the block body including a flange portion in the outer peripheral surface of each of the four sides, the flange portions being formed integrally with the block body and protruding outwardly from the outer peripheral surface, the flange portions having a thickness less than that of the outer peripheral surface, each of the flange portions having a deformed portion which restricts the amount of protrusion of the flange portion, the deformed portions being formed in the flange portions disposed at corner portions of the block body at which the adjoining sides of the block body meet together.

A third invention provides a block body wherein the deformed portions are substantially of an arcuate configuration.

A fourth invention provides a block member comprising a block body of a rectangular configuration having a center point and four sides, the block body including a flange portion in the outer peripheral surface of each of the four sides, the flange portions being formed integrally with the block body and protruding outwardly from the outer peripheral surface, the flange portions having a thickness less than that of the outer peripheral surface, each of the flange portions having a deformed portion which restricts the amount of protrusion of the flange portion, the deformed portion being formed in the central portion of each of the flange portions.

A fifth invention provides a block member wherein the deformed portions are notches substantially of a semicircular configuration or a C-shaped configuration.

A sixth invention provides a panel structure comprising: block members each including a block body of a rectangular configuration having a center point and four sides, the block body including a flange portion in the outer peripheral surface of each of the four sides, the flange portions being formed integrally with the block body and protruding outwardly from the outer peripheral surface, each of the flange portions having a deformed portion which restricts the amount of protrusion of the flange portion, the deformed portions being formed in the flange portions in a symmetric relationship with respect to the center point of the block body; a pair of support members disposed along the front and rear surface, respectively, of the flange portion on each sides of the block member, each of the support members having at least one hole, the position of which corresponding to a position of a space defined by the deformed portions of the adjoining block members; and an attachment means including pairs of bolt and nut, wherein the pair of support members are disposed along the front and rear surfaces of the flange portion on each side of the block member, wherein the pair of support members are tightened together by means of the attachment means, through the use of the holes of the support members and the space defined by the deformed portions of the block members, whereby the flange portions of the block members are clamped by the support members.

A seventh invention provides a panel structure comprising block members each comprising a block body of a rectangular configuration having a center point and four sides, the block body including a flange portion in the outer peripheral surface of each of the four sides, the flange portions being formed integrally with the block body and protruding outwardly from the outer peripheral surface, the flange portions having a thickness less than that of the outer peripheral surface, each of the flange portions having a deformed portion which restricts the amount of protrusion of the flange portion, the deformed portions being formed in the flange portions disposed at corner portions of the block body at which the adjoining sides of the block body meet together; a pair of support members disposed along the front and rear surface, respectively, of the flange portion on each sides of the block member, each of the support members having at least one hole, the position of which corresponding to a position of a space defined by the deformed portions of the adjoining block members; and an attachment means including pairs of bolt and nut, wherein the pair of support members are disposed along the front and rear surfaces of the flange portion on each side of the block member, wherein the pair of support members are tightened together by means of the attachment means, through the use of the holes of the support members and the space defined by the deformed portions of the block members, whereby the flange portions of the block members are clamped by the support members.

A eighth invention provides a panel structure wherein the confronting flange portions of the adjoining block members are clamped by a common pair of support members.

A ninth invention provides a panel structure wherein the support members are of a web-like configuration, and wherein each support member is formed with at least one attachment hole, the position of which corresponding to a space defined by the deformed portions of the block members.

BRIEF DESCRIPTION OF THE DRAWINGS

For a fuller understanding of the nature and objects of the present invention, reference should be had to the following detailed description taken in connection with the accompanying drawings wherein.

DETAILED DESCRIPTION OF THE PREFERRED EMBODIMENTS

Figure 1:
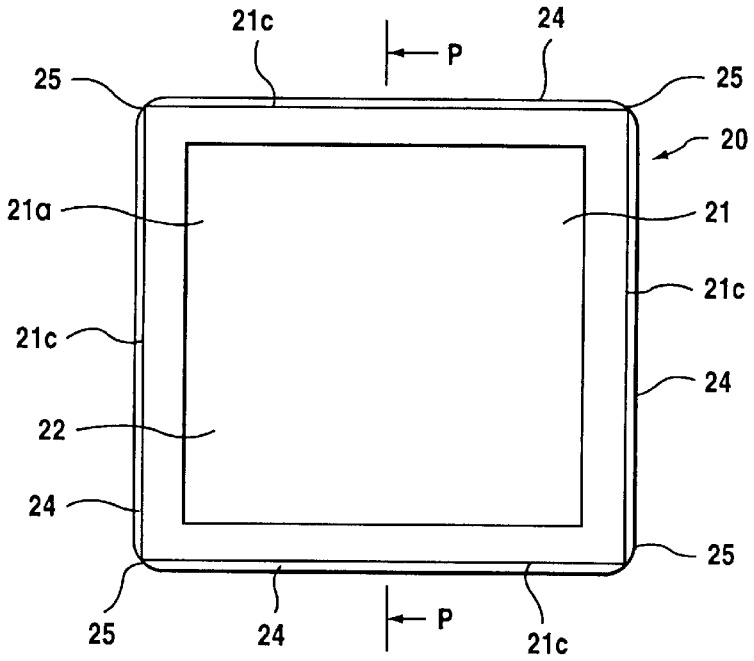
FIG. 1 is a plan view showing a block member according to one embodiment of the invention.
Figure 2:
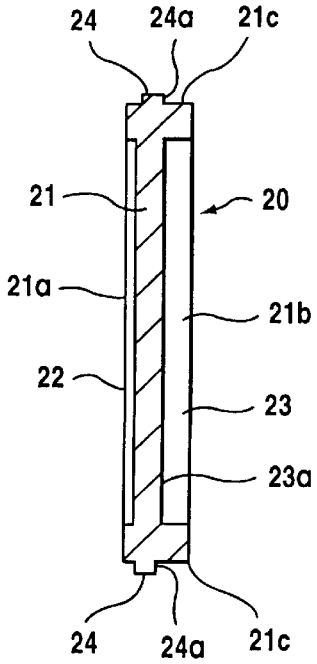
FIG. 2 is a cross-sectional view taken along line P—P in FIG. 1.

One embodiment of a block member according to the invention will be explained below with reference to FIGS. 1 and 2. In these figures, reference numeral 20 designates a block member of a rectangular configuration. The block member may include, for example, a glass block, a glass brick, a glass panel or the like. A brick, a ceramic, a resin material, or a wooden material, in addition to the glass material, may be used as a raw material for the block member. The block member 20 shown in the drawings is formed into a square configuration when viewed in plan view (front view). It is noted, however, that the block member may be formed into an appropriate configuration such as a rectangular, rhombic, triangular, or regular polygonal configuration. The block member 20 includes a block body 21 for example of a rectangular configuration, a first shallow recess 22 formed in one surface (front surface) 21*a* of the block body 21, a second deep recess 23 formed in the opposite surface (rear surface) 21*b* of the block body 21, and a flange portion 24 integrally protruding from the outer peripheral surface 21*c* of each of the four sides of the block body 21, the width of the flange portion 24 being less than that of the outer peripheral surface 21*c*.

The flange 24 has a deformed portion 25 of an arcuate configuration (removed portion) at each corner portion in which the adjoining sides of the block body 21 intersect with each other. Thus, the amount of protrusion (protruded length) of the flange portion from the outer peripheral surface 21*c* is restricted. More specifically, the protruded length of the flange portion is reduced as the flange portion approaches the corner portion. As will be explained later, the adjoining deformed portions 25 form a space 26, when a plurality of block members 20 are arranged in a matrix form so as to be panelized. It is noted that, although the opposite surface 24*a* of the flange portion 24 is shown to be in flush with the bottom surface 23*a* of the recess 23, it may be formed to be offset from the bottom surface 23*a*.

Figure 3:
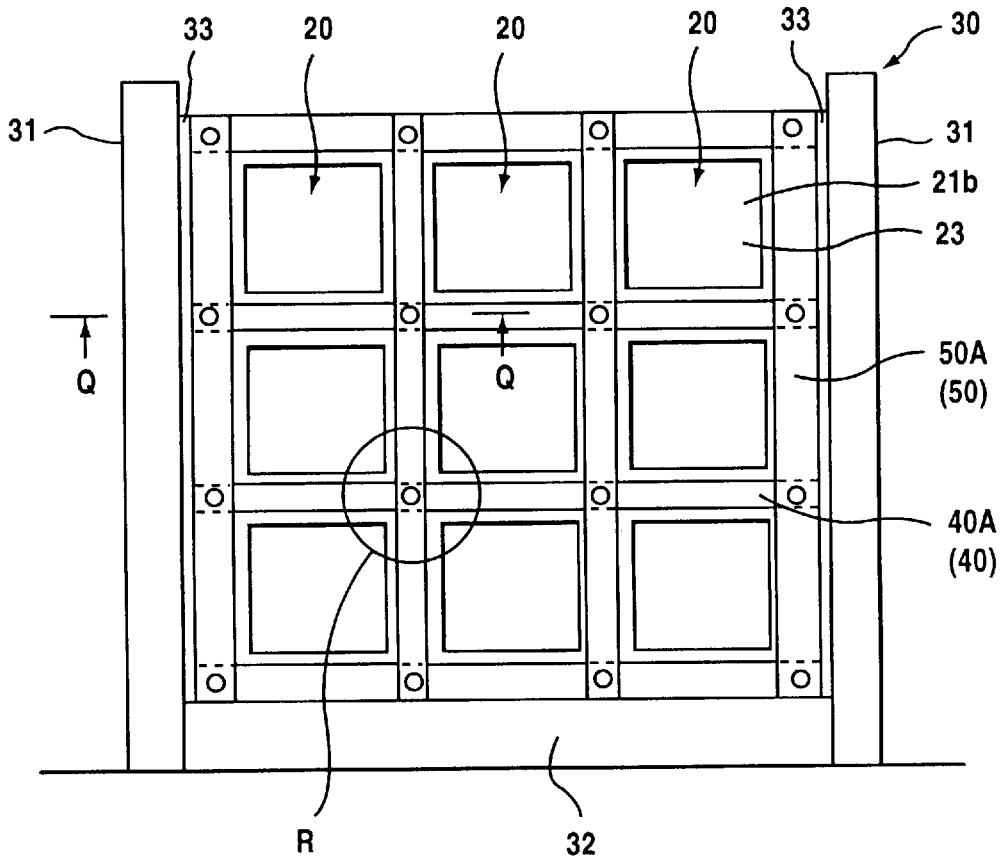
FIG. 3 is a front elevational view showing a panel structure according to one embodiment of the invention.
Figure 4:
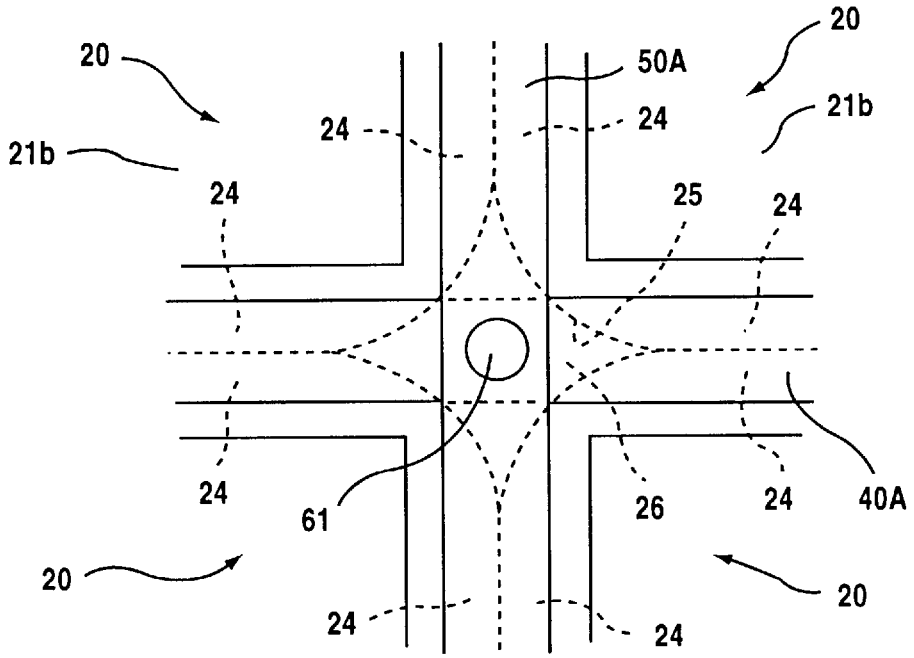
FIG. 4 is an enlarged view of a portion enclosed by a circle R in FIG. 3.
Figure 5:
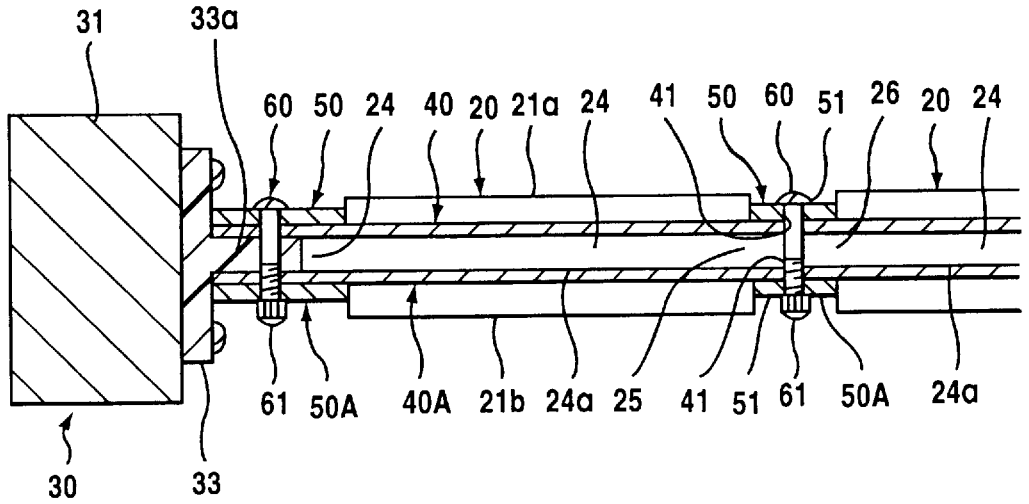
FIG. 5 is a cross-sectional view taken along line Q—Q in FIG. 3.
Figure 6:
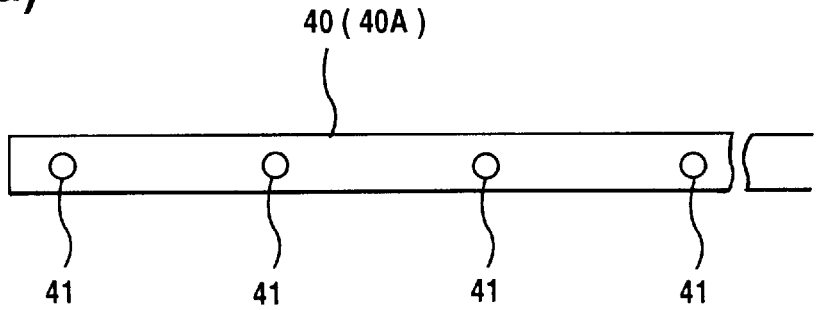
FIG. 6 illustrates support members for use in a panel structure according to the invention, in which FIG. 6(*a*) is a plan view of a main portion of a horizontal support member, and FIG. 6(*b*) is a plan view of a main portion of a vertical support member.
Figure 6:
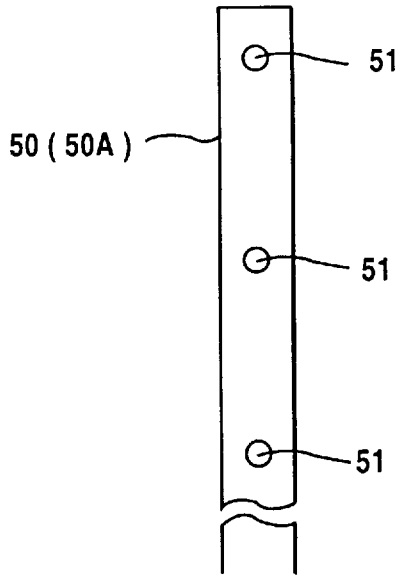

The thus constructed block member 20 is applied, for example, to a panel structure shown in FIGS. 3 to 5. In these figures, reference numeral 30 designates a support frame body. The support frame body 30 includes, for example, support columns 31, 31 spaced apart a predetermined distance from one another, a base member 32 disposed below and fixed to the support columns 31, 31, and end support members 33, 33 disposed upper and fixed to the confronting support columns 31, 31. The end support members 33, 33 have, at their confronting central portion, a support lug 33*a* integral therewith. Each of the support lug 33*a* extends along the entire length of the central portion and has a thickness substantially the same as that of the flange portion of the block member 20, and a protruded length approximately twice that of the flange portion 24. Attachment holes are arranged at a pitch substantially the same as the outer dimension of the block member 20.

In the support frame body 30, a plurality of block members 20 are arranged in a matrix form, with the flange portions 24 being in abutment relative to one another. A caulking compound, such as silicone rubber, may be interposed between the opposed surfaces of the flange portions 24, so as to prevent direct contact between the flange portions. At the adjoining corner portions of the plurality of block members 20, a space is formed which is bounded by the arcuate deformed portions 25. The flange portion 24 on each side of the block member 20 is clamped by support members 40, 40A and vertical support members 50, 50A of a web-like configuration, which are respectively arranged forwardly and rearwardly of the block members and extend horizontally and vertically. The flange portions are tightly clamped by means of an attachment means such as a bolt 60 and a nut (for example, a box nut) 61.

The horizontal support members 40, 40A, and the vertical support members 50, 50A are formed with a plurality of attachment holes 41, 51, respectively. The attachment holes 41, 51 are arranged at a pitch substantially the same as that of the outer dimension of the block member 20 (outer dimension including the flange portion 24). Specifically, the vertical support members 50, 50A disposed adjacent to the support frame body 30 have a width slightly larger than that of the remaining vertical support members 50, 50A. The horizontal support members 40, 40A and the vertical support members 50, 50A, which are not disposed adjacent to the support frame body 30, have a width substantially equal to or slightly larger than twice the protruded length of each side of the block member 20 in which the deformed portion is not formed. Each block member 20 is securely supported by inserting a bolt 60 into each hole 41, 51 in the horizontal support members 40, 40A and the vertical support members 50, 50A, respectively, and through each space 26 and by tightly threading the bolts 60 with corresponding box nuts 61.

A method for assembling the above-mentioned panel structure will be explained below with reference to FIGS. 1 to 6. First, the horizontal support members 40, 40A and the vertical support members 50, 50A are temporarily and lightly secured to the base member 32 and the end support members 33, 33 along their front and rear surfaces by means of bolts 60 and box nuts 61 through the use of the holes 41, 51. A plurality of vertical support members 50, 50A for the front and rear surfaces of the panel structure are disposed between the vertical support members 50, 50A extending along the end support members 33, 33, respectively. The vertical support members are arranged substantially in parallel relative to one another. The vertical support members 50, 50A are temporarily and lightly secured to the horizontal support members 40, 40A extending along the base member 33 by means of the bolts 60 and the box nuts 61. If desired, an appropriate amount of caulking compound is applied to the end surface of the flange portion 24 at each side of the block members 20. Then, such block members 20 are sequentially disposed between the horizontal support members 40, 40A on the base member 32, in a manner that the lower flange portion 24 of each of the block members 20 are clamped between the horizontal support members 40, 40A. In this manner, arrangement for the first row is completed. At this stage, the front and rear surfaces of the flange portions 24, excluding the upper one, of each of the block members 20 are engaged by or disposed adjacent to the horizontal support members 40, 40A and the vertical support members 50, 50A. In this connection, it should be noted that application of the caulking compound to the base member 32, the opposite end surfaces of the support lugs 33*a*, 33*a*, and the block members 20 may be performed when the arrangement of the block members 20 in the first row has been completed. Then, a bolt 60 is inserted in each hole in the horizontal support members 40, 40A, as well as in each lowermost hole (a first hole) in the vertical support members 50, 50A. Each bolt 60 is tightly threaded with a corresponding box nut 61. By this, the lower flange 24 of each of the block members 20 in the first row is securely clamped between the lowermost pair (the first pair) of horizontal support members 40, 40A.

Subsequently, a second pair of horizontal support members 40, 40A are disposed along the front and rear surfaces of the upper flange 24 of each of the block members 20 in the first row. A bolt 60 is inserted into a hole 51 next to the lowermost hole (a second hole) of each of the vertical support members 50, 50A, a hole 41 in each of the second pair of horizontal support 40, 40A, which corresponds to the second hole 51, and each space 26 defined by the deformed portions 25, 25 on each upper side of the adjoining block members 20. Each bolt 60 is temporarily and lightly tightened by a corresponding box nut 61. Then, a second row of block members 20 are disposed on the first row of block members 20, with their flange portions 24 being engaged or disposed adjacent to one another. By this, arrangement for the second row of block members is completed. Each second pairs of bolt 60 and box nut 61 are tightened together. Thus, the upper flange portions of the first row of block members 20 and the lower flange portions 24 of the second row of block members 20 are tightly clamped between the common second pair of horizontal support members 40, 40A. Likewise, the adjoining side or lateral flange portions 24 of the first row of block members 20 are tightly clamped between the common vertical support members 50, 50A. The above-mentioned operation will be similarly repeated, so as to obtain an assembled panel structure shown in FIG. 3.

As mentioned above, the block member 20 applied to the panel structure has, in its peripheral surface 21 on each side thereof, the integral flange portion 24 provided with the deformed portion 25. Thus, the adjoining flange portions 24 of the block members may be simultaneously clamped by means of the horizontal support members 40, 40A and the vertical support members 50, 50A.

It is also noted that the block member 20 is formed, at each corner portion thereof, with the arcuately deformed portion 25. The deformed portions 25 contribute to restrict the amount of protrusion of the flange portions 24. Such deformed portions 25 cooperate to define a space 26 when block members 20 are adjacently disposed. Thus, the adjoining flange portions 24 of the block members 20 are securely and commonly clamped by inserting a bolt 60 in each space 26 and by tightening the bolt 60 with a corresponding box nut 60. In addition to the fact that the adjoining flange portions 24 of the block members 20 may be advantageously and commonly clamped in a secure manner, moldability of the block members 20 may be advantageously improved due to the provision of the deformed portions 25.

It is also noted that the spaces 26 obviate provision of any attachment means in the flange portions. Thus, the block members 20 may be sufficiently securely clamped, even when the protruded length of the flange portions 24 from their outer peripheral surfaces 21*c* is reduced, for example, to about 5 mm.

It is specifically noted that the horizontal support members 40, 40A and the vertical support members 50, 50A are formed into a web-like configuration. Thus, they may be produced simply by cutting a flat material into a predetermined length and by forming holes at a predetermined pitch. This allows easy manufacturing operation, greatly increased production rate, and reduction in production cost of the support members, as well as reduction in production cost of the panel structure.

Since the horizontal and vertical support members are of a web-like configuration as mentioned above, it is unnecessary for the second support of a web-like configuration to be inserted into a slit in the first support of a C-shaped configuration as needed upon assembly of the above-mentioned earlier proposal of the applicant. That is to say, the horizontal and vertical support members according to the invention may be assembled by simply overlapping them relative to one another. Accordingly, the panel structure may be efficiently fabricated or assembled in a short time.

When the panel structure of the invention is applied for example to an exterior wall of a construction, a quantity of caulking compound such as silicone rubber may be applied to the portions, to be engaged or adjacently disposed, of the flange portions 24 of adjoining block members 20. By this, any leakage of water or penetration of wind into the interior (room) of the construction may be reliably prevented. When the panel structure is applied as a partition in a room, it is expected that the caulking compound may serve as a cushioning material between the block members 20, so as to prevent the block members 20 from damage due to strong vibrations or shock.

Figure 7:
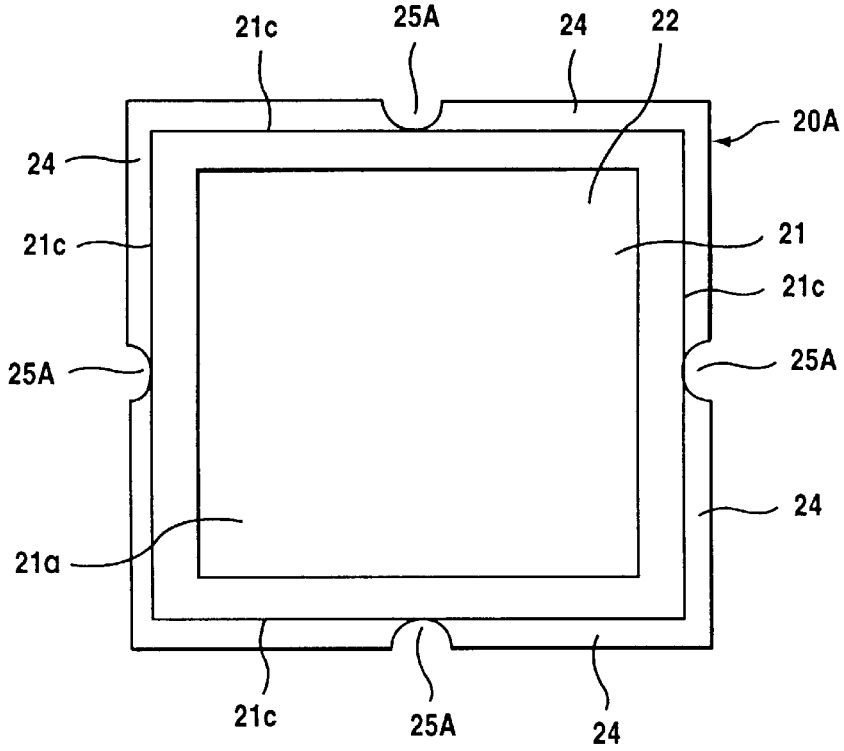
FIG. 7 is a plan view showing a block member according to another embodiment of the invention.

FIG. 7 shows a block member according to another embodiment of the invention. The block member 20A includes, in the outer peripheral surface 21*c* on each side of the block body 21 of a rectangular configuration, flange portions 24 integral therewith. Each flange portion 24 has a thickness less than that of the outer peripheral surface 21*c*. It is specifically noted that the flange portion 24 on each side of the block body 21 is formed, at the central portion thereof, with a deformed portion 25A of a semi-circular configuration which restricts the amount of protrusion of the flange 24 from the outer peripheral surface 21*c*. The deformed portion 25A may be formed, in stead of the semi-circular configuration, into a C-shaped configuration, a triangular configuration or the like.

Figure 8:
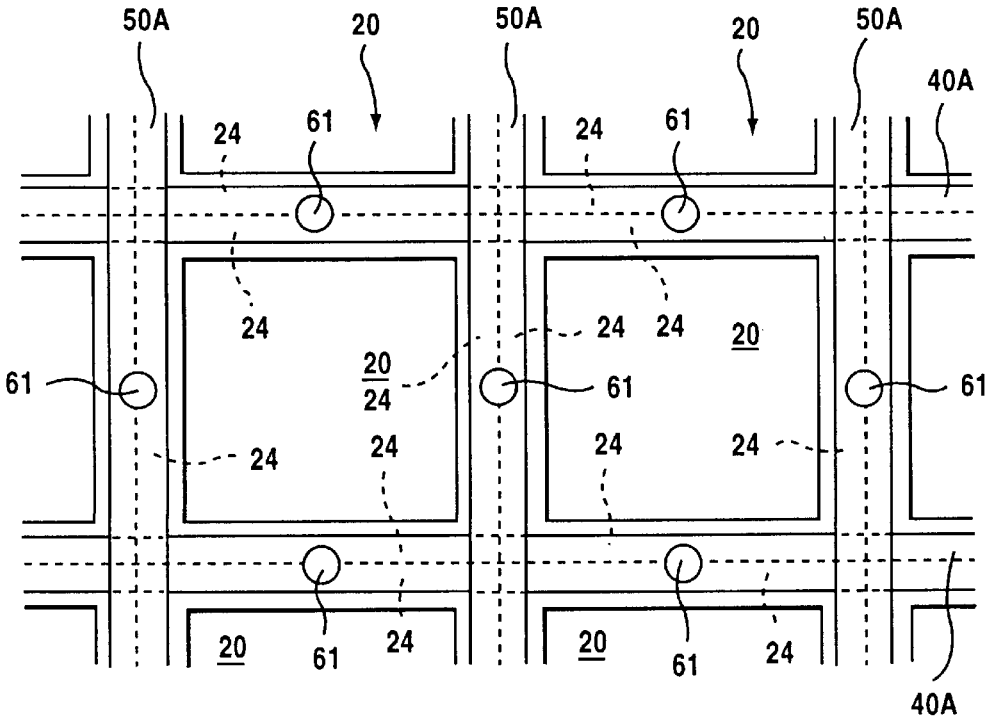
FIG. 8 is a front view showing a main portion of a panel structure in which the block members shown in FIG. 7 is employed.
Figure 9:
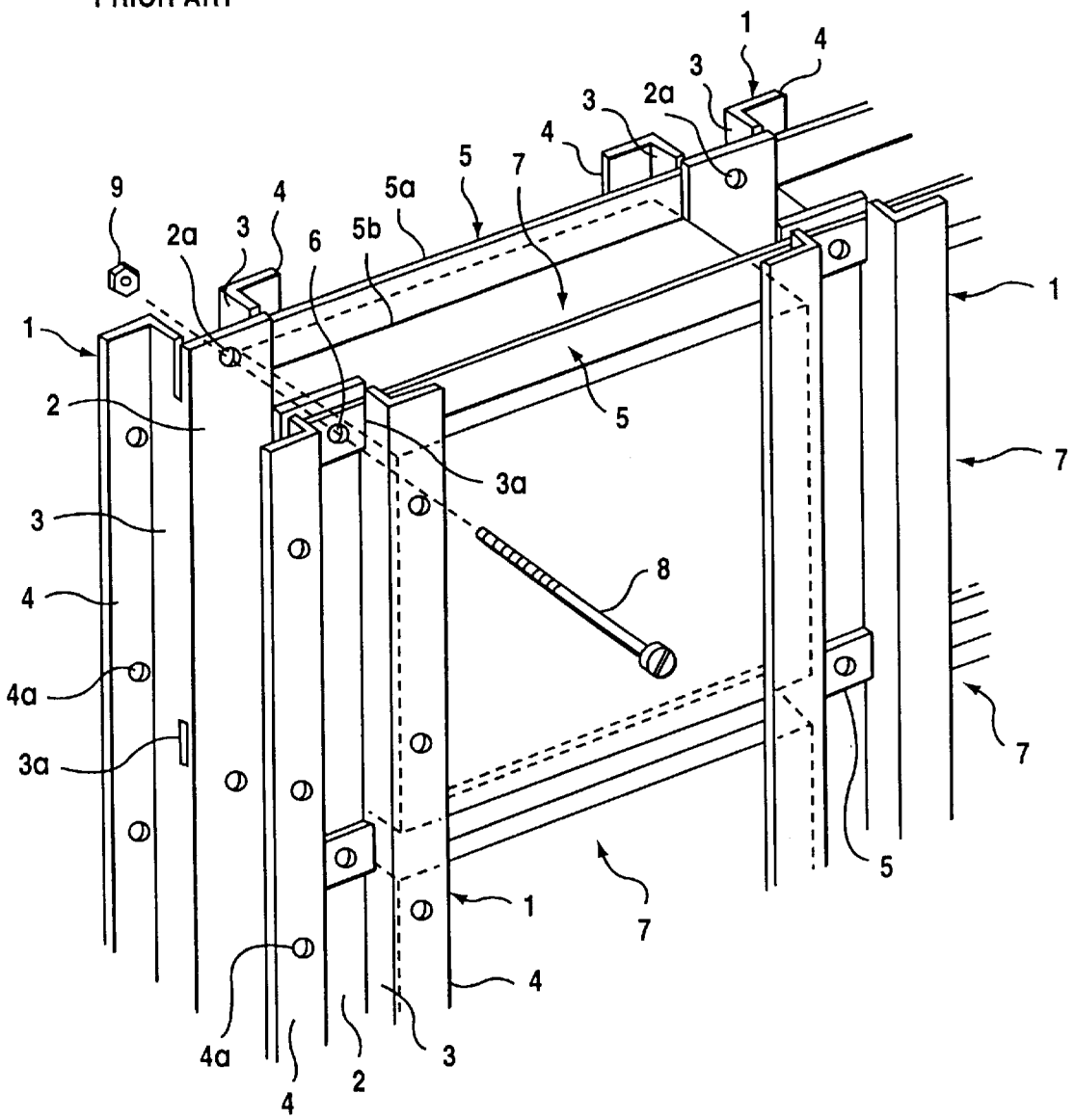
FIG.9 PRIOR ART
FIG. 9 is a perspective view showing a main portion of a panel structure according to prior art.
Figure 10:
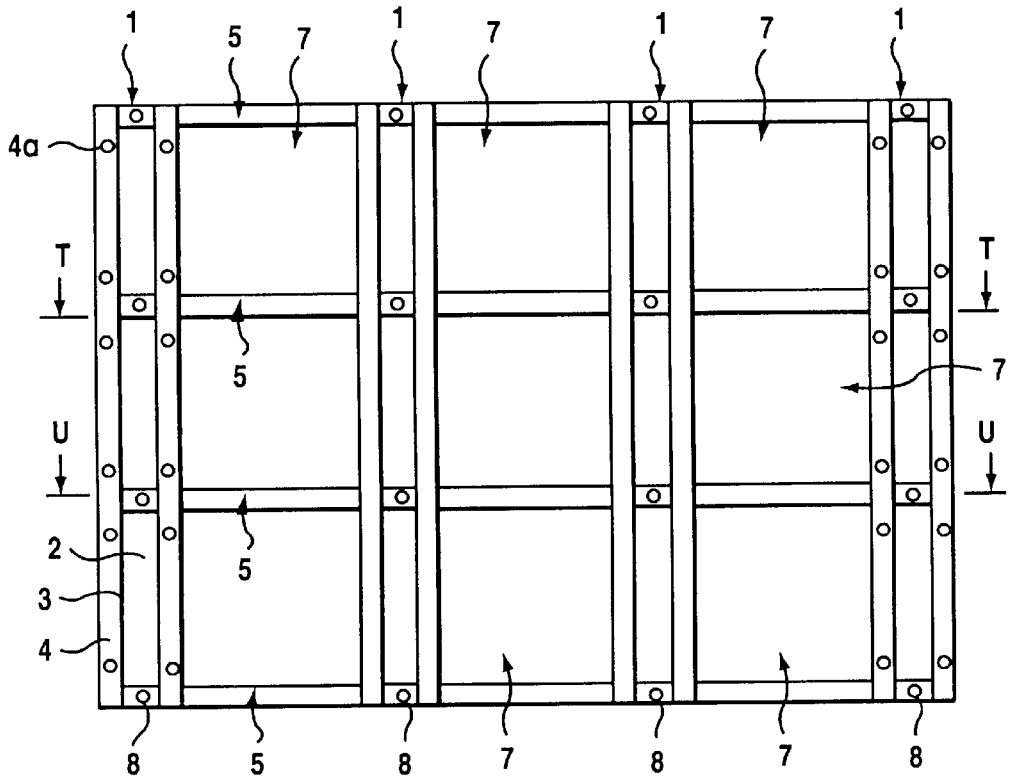
FIG.10 PRIOR ART
FIG. 10 is a front view of the panel structure shown in FIG. 9.
Figure 11:
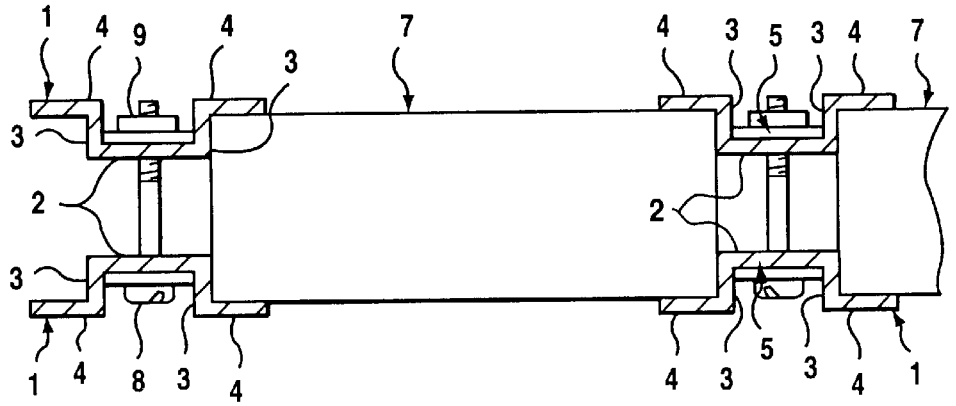
FIG.11 PRIOR ART
FIG. 11 is a cross-sectional view taken along line T—T in FIG. 10.
Figure 12:
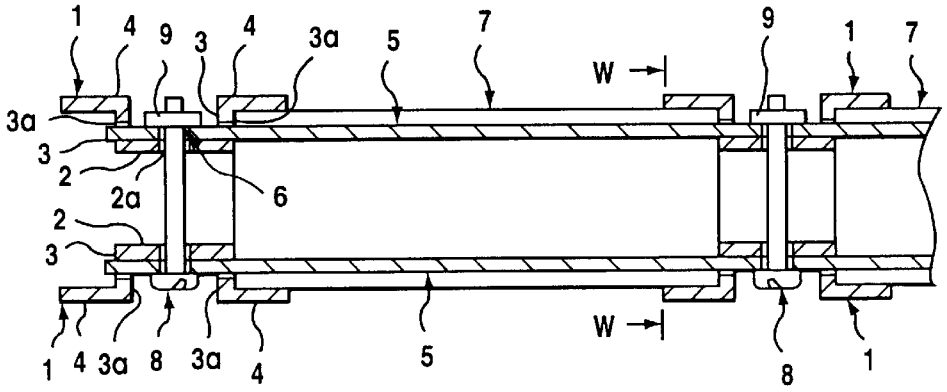
FIG.12 PRIOR ART
FIG. 12 is a cross-sectional view taken along line U—U in FIG. 10.
Figure 13:
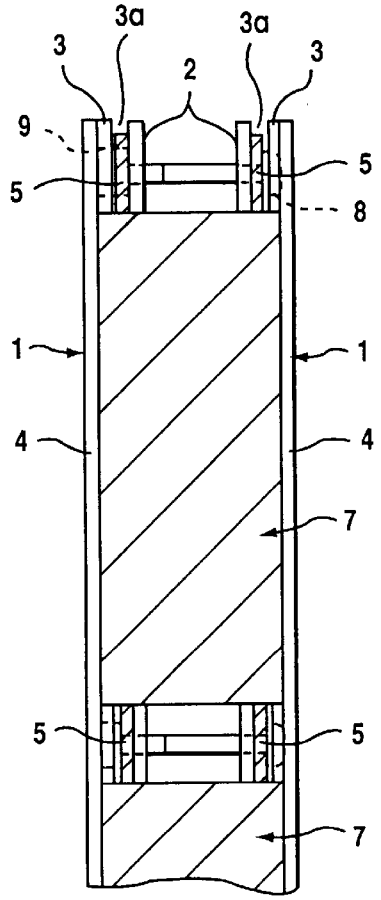
FIG.13 PRIOR ART
FIG. 13 is a cross-sectional view taken along line W—W in FIG. 10.
Figure 14:
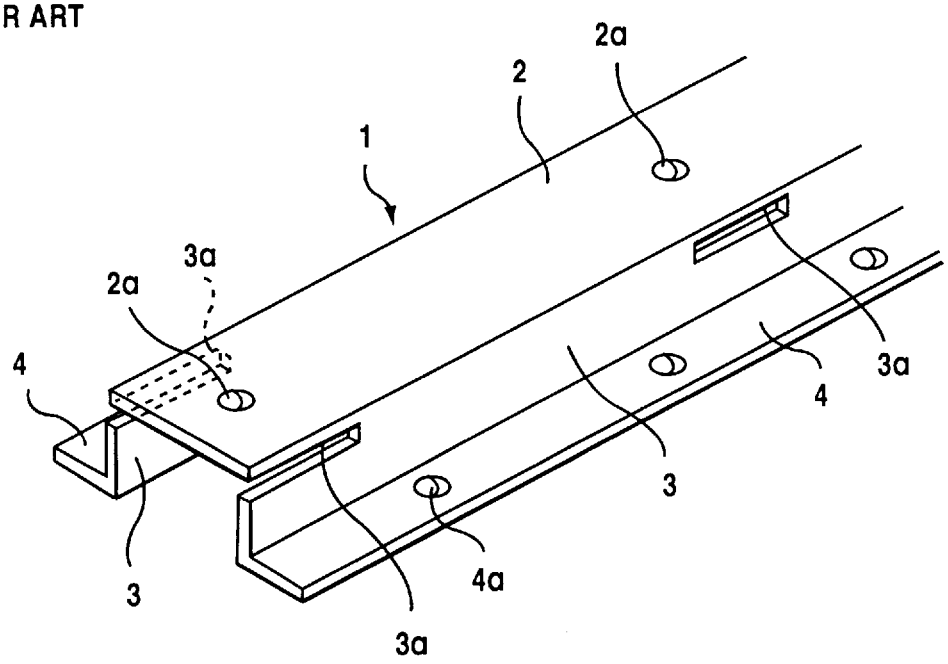
FIG.14 PRIOR ART
FIG. 14 is a plan view showing a horizontal support member according to prior art.
Figure 15:
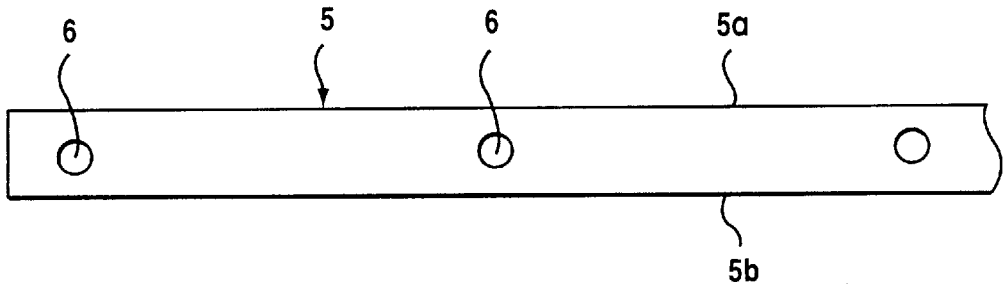
FIG.15 PRIOR ART
FIG. 15 is a plan view showing a vertical support member according to prior art.

The block member 20A may be applied for example to a panel structure shown in FIG. 8. This panel structure is basically the same as that shown in FIGS. 3 to 5 but different in that (1) the position of each hole 41, 51 of the horizontal and vertical support members 40, 40A and 50, 50A is shifted to the central portion of the block member 20A and (2) the deformed portions 25 of the adjoining block members 20A define a space in the central portion of the flange portions 24.

According to this embodiment, the flange portions 24 of the block members 20A are separately clamped by the horizontal support members 40, 40A and the vertical support members 50, 50A, respectively. Thus, the panel structure employing the support members according to this embodiment is slightly less in strength than that of the panel structure employing the support members according to the first embodiment in which the overlapped portions between the horizontal support members 40, 40A and the vertical support members 50, 50A are simultaneously fastened together by means of the fastening means 60, 61. Apart from this point, the panel structure employing the support members according to the second embodiment is expected to have substantially the same effects as those of the panel structure employing the support members according to the first embodiment.

It is noted that the invention is not restricted to the above-mentioned embodiments. For example, the block member may take a form of rectangular, triangular or polygonal configuration, other than the above-mentioned square configuration. More than one deformed portions may be formed in a single side of the flange portion, provided that symmetrical relationship may be obtained with respect to the adjacently disposed block members. The location(s) of the deformed portion may also be appropriately selected. It is also possible to use an L-shaped auxiliary fixture. In this case, one piece of the fixture is fastened to the attachment means located at lowermost stage of the panel structure, while the other piece of the fixture is fixed to the base member by means of a screw. One support member (horizontal or vertical support member) overlying the other support member (vertical or horizontal support member), except the portion at which it is disposed on the underlying support member, may be bent by an amount substantially corresponding to the thickness of the underlying support member. Thus, the overlying support member may be intimately contacted with the flange portion of the block member.

ADVANTAGES OF THE INVENTION

As will be appreciated from foregoing, and in accordance with the present invention, each block member is integrally formed, in the outer peripheral surface of each side thereof, with a flange portion. Thus, adjoining flange portions may be clamped together by means of a pair of support members. This increases support strength for the block members.

Deformed portions, which restrict amount of protrusion of the flange portion, are formed in the outer peripheral portions of the block members in a symmetrical relationship. When a plurality of block members are adjacently disposed, a space is formed by the deformed portions. This space may be used when tightening operation is performed using an attachment means. It is also possible to reduce the protruded length of the flange from the peripheral surface. This permits reduction in width of the support members. Accordingly, and contrariwise to prior art, the support member is prevented from overlapping the block member. The area by which the support members occupy in the panel structure may be decreased. This provides superior appearance of the panel structure.

It is specifically noted that horizontal and vertical support members are both of a web-like configuration. Thus, they may be easily produced simply by cutting a flat material into a predetermined width. The length of the support members may be appropriately adjusted. Thus, the support members may be produced easily. Mass productivity is also significantly increased. Accordingly, it is possible to reduce production cost for support members and panel structure.

The horizontal and vertical support members of a web-like configuration obviate the cumbersome operation in prior art in which a second or horizontal support member is inserted into a slit of a first or vertical support member of a C-shaped configuration. The support members according to the invention may be simply overlapped with each during assembling or fabricating process. This permits efficient fabrication work in a short period of time.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

I claim:

1. A block member comprising a block body of a rectangular configuration having a center point and four sides, the block body including a flange portion in the outer peripheral surface of each of the four sides, the flange portions being formed integrally with the block body and protruding outwardly from the outer peripheral surface, the flange portions having a thickness less than that of the outer peripheral surface, each of the flange portions having an arcuate deformed portion which restricts the amount of protrusion of the flange portion, the deformed portions being formed in the flange portions at corner portions of the block body at which the adjoining sides of the block body meet together for inserting an attachment means for connecting a pair of support members which are to be disposed along the front and rear surface, respectively, of the flange portion on each sides of the block member.

2. A panel structure comprising: block members each including a block body of a rectangular configuration having a center point and four sides, the block body including a flange portion in the outer peripheral surface of each of the four sides, the flange portions being formed integrally with the block body and protruding outwardly from the outer peripheral surface, each of the flange portions having a deformed portion which restricts the amount of protrusion of the flange portion, the deformed portions being formed in the flange portions in a symmetric relationship with respect to the center point of the block body; a pair of support members disposed along the front and rear surface, respectively, of the flange portion on each sides of the block member, each of the support members having at least one hole, the position of which corresponding to a position of a space defined by the deformed portions of the adjoining block members; and an attachment means including pairs of bolt and nut, wherein the pair of support members are disposed along the front and rear surfaces of the flange portion on each side of the block member, wherein the pair of support members are tightened together by means of the attachment means, through the use of the holes of the support members and the space defined by the deformed portions of the block members, whereby the flange portions of the block members are clamped by the support members.

3. A panel structure comprising block members each comprising a block body of a rectangular configuration having a center point and four sides, the block body including a flange portion in the outer peripheral surface of each of the four sides, the flange portions being formed integrally with the block body and protruding outwardly from the outer peripheral surface, the flange portions having a thickness less than that of the outer peripheral surface, each of the flange portions having a deformed portion which restricts the amount of protrusion of the flange portion, the deformed portions being formed in the flange portions disposed at corner portions of the block body at which the adjoining sides of the block body meet together; a pair of support members disposed along the front and rear surface, respectively, of the flange portion on each sides of the block member, each of the support members having at least one hole, the position of which corresponding to a position of a space defined by the deformed portions of the adjoining block members; and an attachment means including pairs of bolt and nut, wherein the pair of support members are disposed along the front and rear surfaces of the flange portion on each side of the block member, wherein the pair of support members are tightened together by means of the attachment means, through the use of the holes of the support members and the space defined by the deformed portions of the block members, whereby the flange portions of the block members are clamped by the support members.

4. A panel structure according to claims 2 or 3 wherein the confronting flange portions of the adjoining block members are clamped by a common pair of support members.

5. A panel structure according to claims 2 or 3 wherein the support members are of a web-like configuration, and wherein each support member is formed with at least one attachment hole, the position of which corresponding to a space defined by the deformed portions of the block members.

* * * * *